US006376014B1

(12) United States Patent
Mihalcheon

(10) Patent No.: US 6,376,014 B1
(45) Date of Patent: Apr. 23, 2002

(54) DISPENSER FOR USE WITH A POLYURETHANE MIXING HEAD

(76) Inventor: Arthur A. Mihalcheon, 74 Valleyview Crescent, Edmonton, Alberta (CA), T5R 5T1

( * ) Notice: Subject to any disclaimer, the term of this patent is extended or adjusted under 35 U.S.C. 154(b) by 0 days.

(21) Appl. No.: 09/536,073

(22) Filed: Mar. 24, 2000

(51) Int. Cl.[7] ..... B05D 3/12; B05D 5/00

(52) U.S. Cl. ..... 427/240; 427/244; 427/247; 427/373; 427/385.5; 118/54; 118/304; 118/323

(58) Field of Search ..... 427/240, 244, 427/247, 373, 385.5, 226, 426; 118/54, 304, 323; 239/223, 224

(56) References Cited

U.S. PATENT DOCUMENTS 3,738,895 A * 6/1973 Paymal ..... 156/443
4,278,045 A 7/1981 Ahmad
4,282,729 A * 8/1981 Smith ..... 68/205 R
4,333,973 A * 6/1982 Bellafiore et al. ..... 427/424
4,442,979 A * 4/1984 Kupper ..... 239/656
4,568,003 A 2/1986 Sperry et al.
5,356,050 A 10/1994 Hahn et al.
5,452,853 A 9/1995 Shook et al.

* cited by examiner

*Primary Examiner*—Shrive P. Beck
*Assistant Examiner*—Jennifer Calcagni
(74) *Attorney, Agent, or Firm*—Sheridan Ross P.C.

(57) ABSTRACT

A spinning cone is positioned directly below a mixing head outlet to dispense and distribute a sticky mixture of polyurethane foam liquid chemical components. The mixing head and cone are reciprocated together across a longitudinally advancing metal strip to substantially uniformly distribute the mixture thereon. The procedure is practised in connection with the fabrication of overhead door insulated panels. In the prior art, plugging of dispensers would commonly occur within minutes, due to a build-up of adhering mixture on a surface followed by foaming. The spinning cone has dispensed satisfactorily for hours at a time.

3 Claims, 4 Drawing Sheets

DISPENSER FOR USE WITH A POLYURETHANE MIXING HEAD

FIELD OF THE INVENTION

The present invention relates to an assembly and process for applying a mixture of chemical components, for producing polyurethane foam, onto a longitudinally advancing metal strip. The invention finds application in the production of foam-insulated panels used in overhead doors, insulated building panels and insulating board.

BACKGROUND OF THE INVENTION

It is conventional to produce foam-insulated panels as follows:

- a pair of metal strips, one spaced directly above the other, are advanced together,
- a mixing/dispensing assembly is positioned between the strips. The assembly comprises a polyurethane mixing head having an attached dispenser, for admixing the polymerizable chemical components (organic resin and polyisocyanate) which react to produce polyurethane foam and delivering the produced mixture onto the lower strip;
- the mixing/dispensing assembly is reciprocated transversely across the advancing lower strip to distribute the mixture thereacross; and
- the strips then converge closer together and are advanced through a long heating oven to cause the mixture to foam, fill the space between the strips and solidify into insulating polyurethane foam which is bonded to the two strips.

There are a number of commercially available mixing heads on the market for mixing the chemical components. A typical example brings separate streams of the two polyurethane foam-producing components through a pair of passageways formed in the mixing head and discharges them under pressure through opposed outlets into a mixing chamber and an angularly positioned port leading to the dispenser. The components mix turbulently as they meet and proceed together through the chamber and port.

There are also a number of commercially available dispensers, each of which is mounted on a reciprocating arm or carriage, for distributing the foam mixture produced by the mixing head onto the moving strip. For example, one known dispenser is a tube, perforated along its length and closed at its outer end, which delivers the mixture in the form of a plurality of parallel streams of small diameter. A second known dispenser is a hopper-like nozzle having a bottom slot which delivers the mixture in the form of an elongate, thin curtain.

In connection with these assemblies it is desirable:

- that the components be well mixed;
- that the mixture be evenly distributed over the bottom strip; and
- that the assembly not plug readily, so that it can operate for several hours without interruption.

However, in our experience these objectives have not been achieved using the commercial mixing/dispensing assemblies heretofore available. In our testing with a variety of mixing heads and dispensers, of conventional design and of our own design, we repeatedly experienced rapid plugging, often within a few minutes. The chemical mixture is very sticky and tends to adhere to the metal surface of the mixing head port and to the internal surfaces of the dispenser. The adhering material will foam up and plug one or both of these devices. In addition, even distribution of the mixture was difficult to sustain. For example, in the case of the perforated tube, some of the perforations would begin to plug while others would remain open - as a result distribution would become uneven. There would be areas where less than the optimum quantity of mixture would be deposited. These plugging and distribution problems led to one or more of the following undesirable results:

- Void spaces being present in the cured insulation;
- Poor bonding of the cured insulation to the metal strips;
- Costly shut-downs to deal with the plugging; and
- The production of a high proportion of poor quality or defective panels, with corresponding losses and customer dissatisfaction.

SUMMARY OF THE INVENTION

In accordance with the present invention, a spinning cone, having a downwardly sloped surface, is positioned in spaced relation directly beneath the port outlet from the mixing head. The head and spinning cone are reciprocated together across the advancing bottom strip to distribute the chemical mixture along a zigzag path. Preferably the adjacent strips of laid-down mixture overlap along their margins.

It has been shown that the spinning cone is not susceptible to plugging. In addition it appears to contribute to improved mixing of the chemical components.

In a preferred feature, the cylindrical surface of the port of the mixing head is coated with a non-adhering material such as Teflon™. As a result of this change, plugging of the port has been reduced. It has also been found useful to coat the top surface of the cone with Teflon or the like—the build-up of foam thereon is thereby reduced.

By combining these features, test runs of 5–8 hours duration have been achieved without plugging. In addition, improved mixing of the mixture components and uniformity of distribution of the mixture has been achieved, thereby reducing the incidence of void spaces and improving bonding of the foam to the metal skin.

Broadly stated, in one aspect the invention comprises a method of applying a liquid mixture of polyurethane foam components onto the top surface of a metal strip being advanced longitudinally, comprising: delivering a stream of the mixture from a mixing head having an outlet onto the apex of a spinning cone positioned directly beneath the outlet and above the strip, to dispense the mixture onto the strip; and reciprocating the mixing head and cone together transversely across the longitudinally advancing strip to evenly distribute the dispensed mixture across the top surface of the strip.

In another aspect, the invention comprises a reciprocating mixing/dispensing assembly for delivering a mixture of polyurethane foam components onto a longitudinally advancing strip, comprising: a mixing head for mixing the components and producing a mixture thereof through an outlet; a cone, having an apex positioned centrally beneath the outlet; means for spinning the cone to dispense the mixture onto the strip; and means for reciprocating the mixing head and cone together across the strip to distribute the dispensed mixture thereon.

DESCRIPTION OF THE PREFERRED EMBODIMENT

Figure 1:
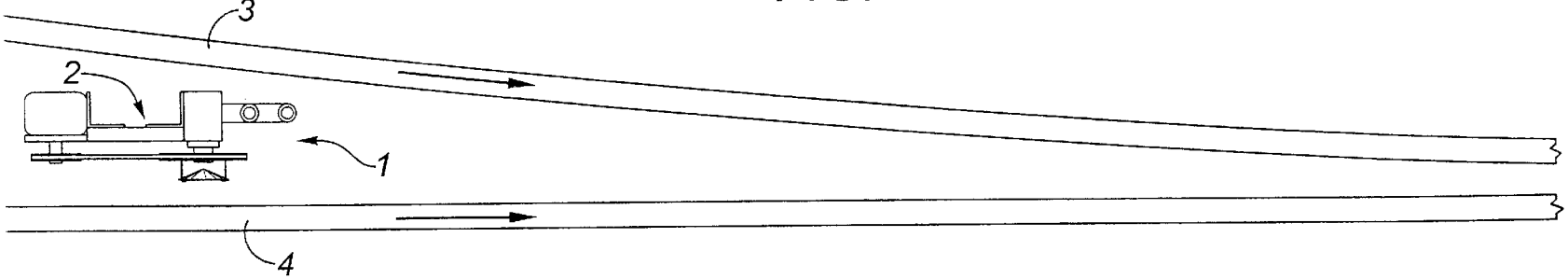
FIG. 1 is a schematic side view showing the mixing dispensing assembly positioned between converging, longitudinally advancing metal strips, arranged for the production of insulated panels.
Figure 2:
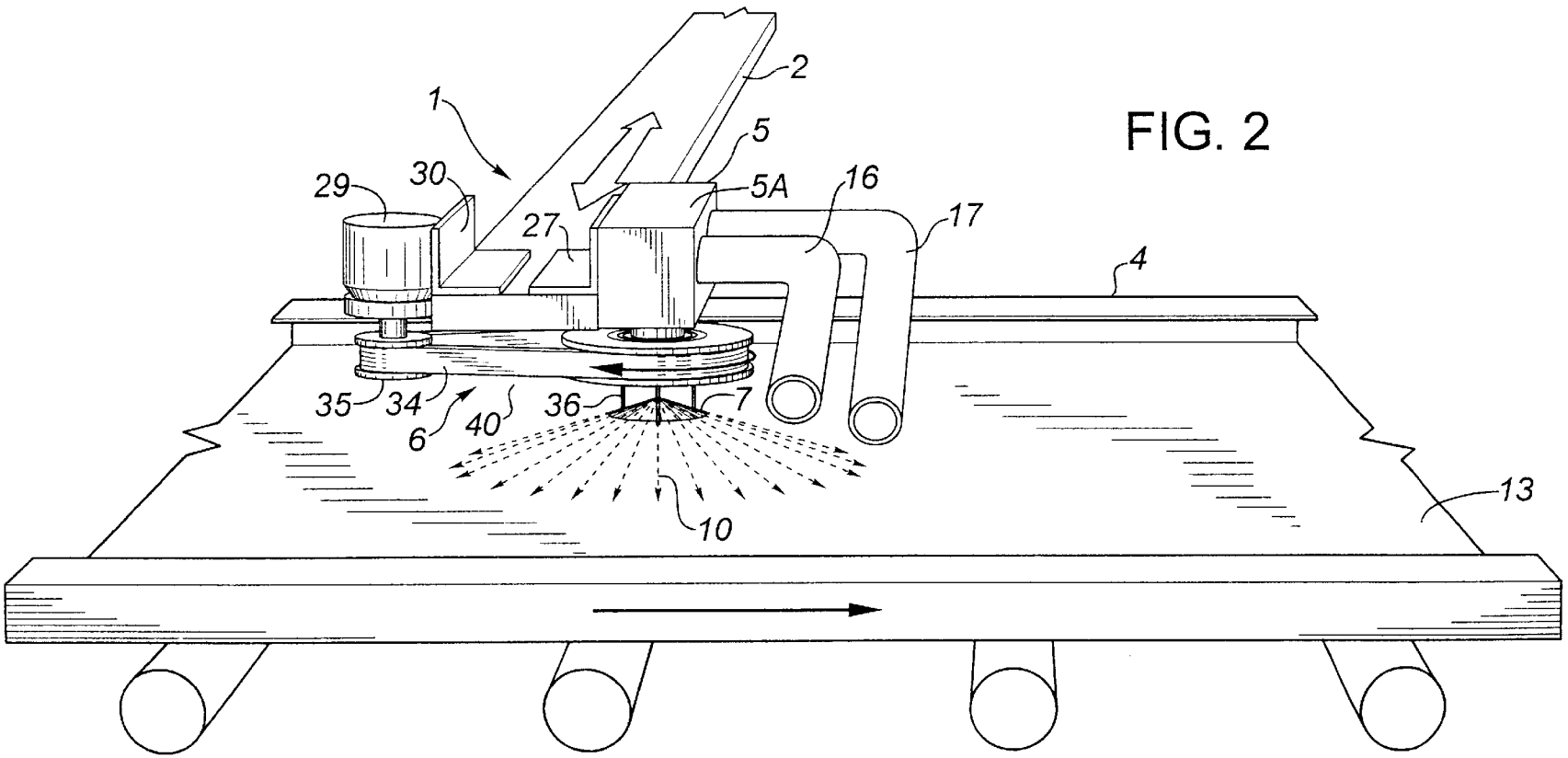
FIG. 2 is a perspective view of the assembly distributing chemical mixture onto the lower strip.
Figure 3:
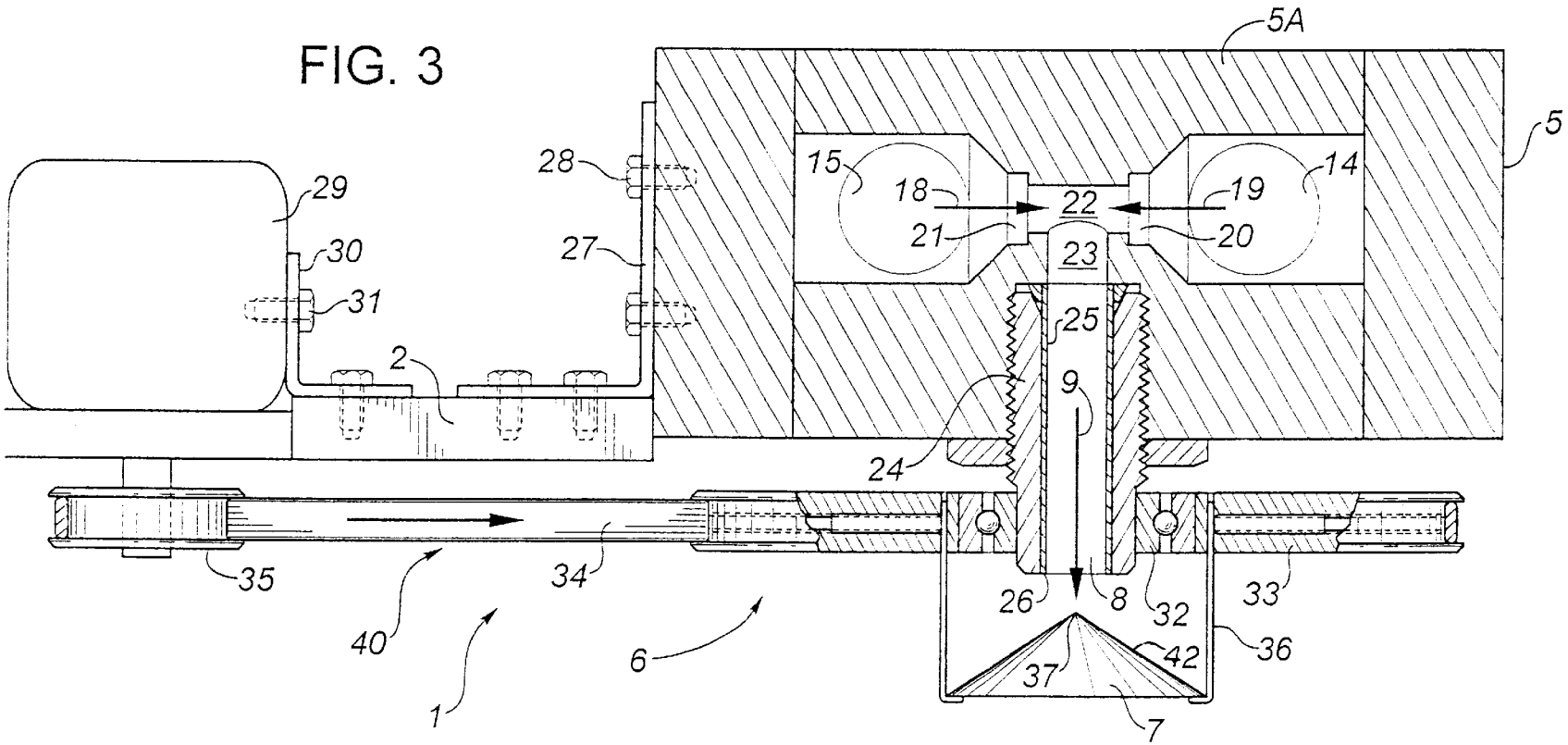
FIG. 3 is a partly sectional side view of the mixing head, dispenser and drive means.
Figure 4:
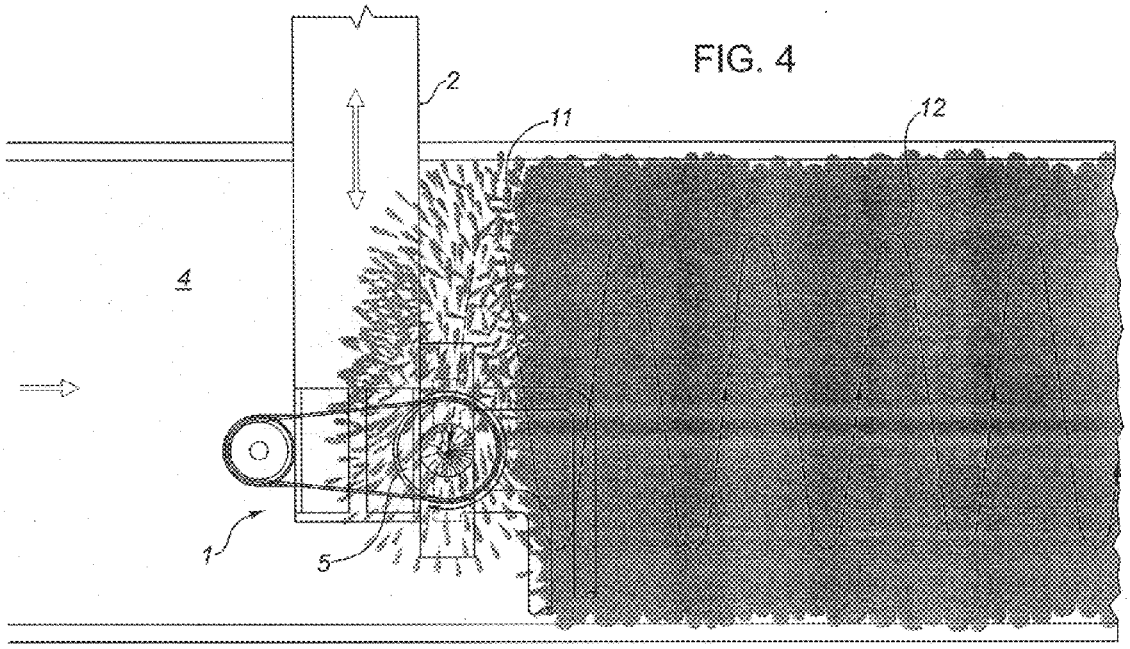
FIG. 4 is a fanciful plan view of the overlapping strips of chemical mixture laid down by the assembly.

As shown in FIGS. 1, 2 and 4, a mixing/dispensing assembly 1 is mounted on a conventional reciprocating arm 2. The assembly 1 is positioned between top and bottom metal strips 3, 4. The strips 3, 4 are advanced longitudinally while the assembly 1 is reciprocated back and forth. The assembly 1 includes a polyurethane mixing head 5 and a dispenser 6. The dispenser 6 comprises a spinning cone 7 positioned centrally beneath the outlet 8 of the mixing head 5. The mixing head 5 is operative to produce a pressurized stream 9 of a mixture of chemical components which produce polyurethane foam when cured by heat. The spinning cone 7 is operative to dispense the mixture 10 in the form of a band 11 following a zig-zag path 12 back and forth across the top surface 13 of the bottom strip 4.

The mixing head 5 is conventional. It has separate passageways 14, 15 connected to hoses 16, 17 for the supply of chemical component streams 18, 19 of resin and polyisocyanate respectively. The passageways 14, 15 discharge the streams 18, 19 through opposed orifices 20, 21 into a mixing chamber 22. The mixing chamber 22 connects with a port 23 formed by a perpendicularly oriented tubular port member 24. The inner surface 25 of the port member 24 is coated with a layer 26 of Teflon. The port member 24 is screw-threaded into the mixing head body 5*a*.

The mixing head 5 is mounted by a bracket 27 and screws 28 to the reciprocating arm 2.

The dispenser 6 comprises a cone 7 and means 40 for spinning the cone. The spinning means 40 comprises a motor 29 mounted to the arm 2 by bracket 30 and screws 31. A bearing assembly 32 is secured to the end of the port member 24. A pulley 33 is rotatably mounted on the bearing assembly 32. A drive belt 34 connects the motor output shaft sheave 35 with the pulley 33. A plurality of holder wires 36 are connected with the sheave 33 and support the cone 7. As shown, the apex 37 of the cone 7 is positioned directly below and close to the outlet 8 of the mixer head port 23. The cone apex 37 is aligned with the axis of the port 23. The surface 42 of the cone 7 is coated with $\text{Teflon}_1$.

In operation, the arm 2 is reciprocated to move the mixing/dispensing assembly 2 back and forth across the advancing bottom strip 4. The means 40 rotate or spin the cone 7. The mixture stream 9 issuing under pressure from the port outlet 8 strikes the downwardly sloped, spinning top surface 42 of the cone 7 and is dispersed and thrown outwardly to deposit as a band 11 on the surface 13 of the bottom strip 4. The band 11 follows a zig-zag path 12 across the strip. The rate of advance of the strip and rate of reciprocation of the mixing/dispensing assembly are coordinated so that the bands 11 overlap slightly along their side edges.

The scope of the invention is defined by the claims now following.

THE EMBODIMENTS OF THE INVENTION IN WHICH AN EXCLUSIVE PROPERTY OR PRIVILEGE IS CLAIMED ARE DEFINED AS FOLLOWS:

1. A method of applying a liquid mixture of polyurethane foam components onto a top surface of a metal strip being advanced longitudinally, comprising:

delivering a stream of the mixture from a mixing head having an outlet onto the apex of a spinning cone positioned directly beneath the outlet and above the strip, to disperse the mixture onto the strip; and reciprocating the mixing head and cone together transversely across the longitudinally advancing strip to evenly distribute the dispensed mixture across the top surface of the strip.

2. The method as set forth in claim 1 wherein:

the mixture is dispensed as bands having side edges and extending across the top surface of the strip and the bands overlap along their side edges.

3. A reciprocating mixing/dispensing assembly for delivering a mixture of polyurethane foam components onto a longitudinally advancing strip, comprising:

a mixing head, having an outlet, for mixing the components and producing a mixture thereof through an outlet;

a cone, having an apex positioned centrally beneath the outlet;

means for spinning the cone to dispense the mixture onto the strip; and means for reciprocating the mixing head and cone together across the strip to distribute the dispensed mixture thereon.

* * * * *